United States Patent [19]

Byrnes, Sr.

[11] 4,004,295

[45] Jan. 25, 1977

[54] PROTECTIVE GLOVE CONSTRUCTED OF FLEXIBLE STRANDS OF METAL WIRE AND FIBER YARN

[76] Inventor: Robert M. Byrnes, Sr., 6720 N. 16th St., Omaha, Nebr. 68110

[22] Filed: Dec. 30, 1975

[21] Appl. No.: 645,477

[52] U.S. Cl. ..... 2/161 R; 2/167

[51] Int. Cl.[2] ..... A41D 19/00

[58] Field of Search ..... 2/158, 159, 161 R, 161 A, 2/16–20, 167, 168, 46, 48; 139/425 R

[56] References Cited

UNITED STATES PATENTS

| | | | |
|---|---|---|---|
| 1,250,150 | 12/1917 | DuBois | 2/167 X |
| 2,864,091 | 12/1958 | Schneider | 2/167 X |
| 3,087,699 | 4/1963 | Foster | 139/425 R |
| 3,883,898 | 5/1975 | Byrnes | 2/167 |

*Primary Examiner*—G. V. Larkin
*Attorney, Agent, or Firm*—Clarence A. O'Brien; Harvey B. Jacobson

[57] ABSTRACT

A protective glove for use by persons engaged in various operations in meat packing or processing plants such as an operator who uses a knife during various meat cutting procedures in which one hand usually holds the knife and manipulates it adjacent the other hand or other portions of the body which frequently results in accidental injury. The glove is constructed from a flexible fiber and a small wire fiber combined in a conventional manner of constructing gloves with the non-metallic fiber preferably being an aramid fiber having unique properties advantageously employed in such articles of manufacture with the fiber being manufactured by the DuPont Company of Wilmington, Del., under the trademark "Kevlar." The metallic wire fiber or strands are flexible, quite strong and materially strengthens the glove and renders it more durable and aids in preventing penetration of the glove by a knife blade or the like. The glove is of light-weight construction and may be provided with various wrist lengths and without straps or buckles thereby eliminating failure of such items and the tendency of such items to catch on various machines and the like.

2 Claims, 3 Drawing Figures

PROTECTIVE GLOVE CONSTRUCTED OF FLEXIBLE STRANDS OF METAL WIRE AND FIBER YARN

BACKGROUND OF THE INVENTION

1. Field of the Invention

The present invention generally relates to protective garments and more particularly protective gloves especially constructed for use in meat processing or packing plants for protecting employees engaged in various operations in such a plant thus enabling such personnel to more safely and effectively perform their duties and to provide a long-lasting, light weight and durable protective glove.

2. Description of the Prior Art

In meat packing and processing plants, a substantial number of persons are engaged in meat cutting operations in which sharp knives must be manipulated in a rapid but yet positive manner in order to efficiently perform their duties. The manipulation of such knives frequently results in accidents or the user of such a knife will accidentally cut himself. Various safety garments have been developed and are being used in meat packing plants with such garments being in the form of gloves, arm guards, aprons and the like. One type of previously employed safety glove or garment is constructed of metal mesh material in the form of a plurality of small metal rings connected together to form a mesh-like metal fabric. In my prior U.S. Pat. No. 3,883,898, issued May 20, 1975, there is disclosed a protective glove constructed of aramid fiber manufactured by DuPont under the trademark "Kevlar" and this patent sets forth existing problems with the previously employed metal mesh gloves and other protective garments. While the "Kevlar" glove disclosed in my prior U.S. Pat. No. 3,883,898 is completely satisfactory in most uses, in certain instances, a more durable and stronger glove is desirable.

SUMMARY OF THE INVENTION

An object of the present invention is to provide a protective glove for use in meat processing plants and the like constructed of a combination of aramid fiber (Kevlar) which is non-metallic, flexible and highly resistant to penetration when formed into a glove and a flexible metallic fiber, strand or wire which is quite small but strong and suufficiently flexible to enable flexing of the glove necessary for proper handling of the meat products, knives and related equipment.

Another object of the invention is to provide a protective glove in accordance with the preceding object in which the wrist length of the glove may be varied so that the glove may protect the hand as well as the wrist and, if desired, extend all of the way to the elbow for protecting the forearm from being cut by using sharp knives and the like, thus replacing a conventionally employed arm guard.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
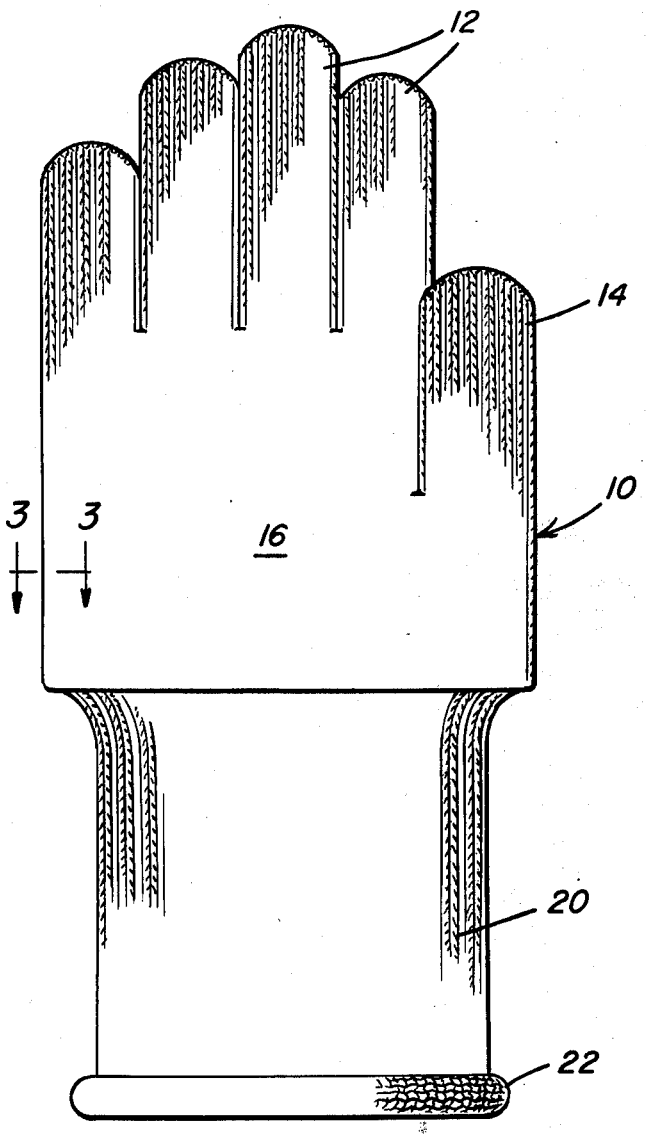
FIG. 1 is a plan view of a safety glove constructed in accordance with the present invention.
Figure 2:
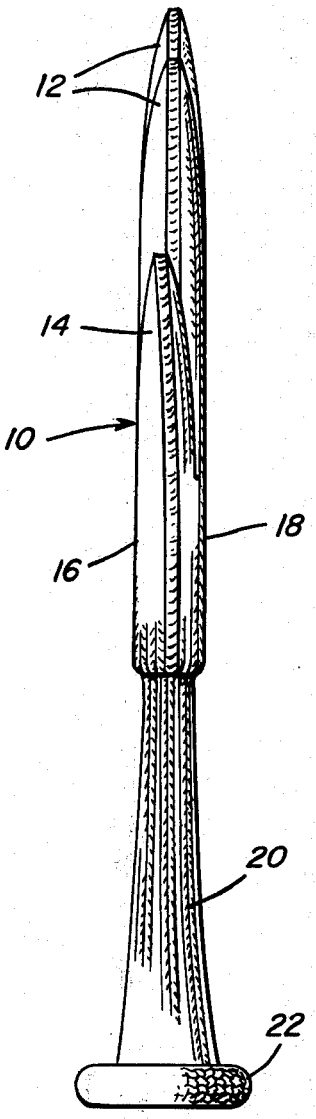
FIG. 2 is a side edge elevational view thereof as observed from the thumb side.
Figure 3:
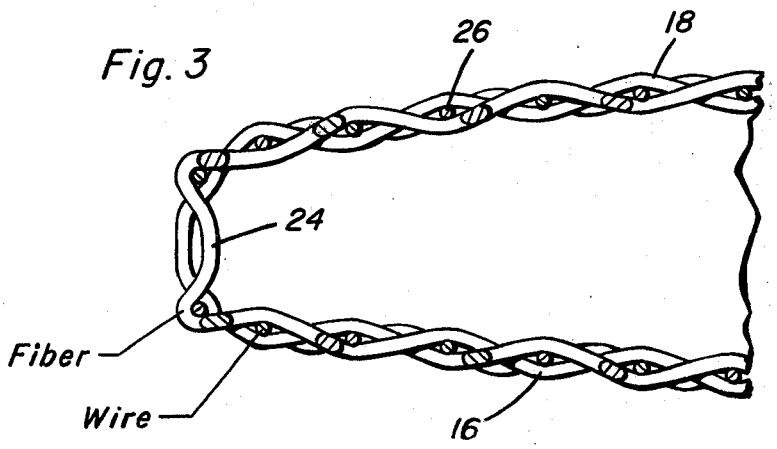
FIG. 3 is a fragmental sectional view, on an enlarged scale, taken substantially upon a plane passing along section line 3—3 of FIG. 1 illustrating the relationship of the non-metallic fiber and the metallic fiber incorporated into the glove construction.

The drawings illustrate a glove 10 having the usual fingerstalls 12, thumbstall 14, front panel 16, rear panel 18 and a wrist cuff 20 which may be provided with a rolled edge 22. The glove is constructed of non-metallic fiber yarn or strands 24 combined with metallic fiber strands 26 in the form of wire. The glove 10 is constructed by utilizing conventional manufacturing techniques presently employed in constructing gloves of natural fibers and may be woven, knitted, non-woven or constructed in any conventional manner.

The non-metallic fibers 24 are in the form of yarn strands of aramid fiber which is commercially available from the DuPont Company under the trademark Kevlar. This material is quite strong and has unusually high resistance to penetration as well as resistance to stretch and can tolerate rather high temperatures such as encountered when laundering and sterilizing the gloves. In addition, this material is quite flexible and will not break and drop into the meat product thereby eliminating one source of contamination. This material is also resistant to absorption of water, blood, moisture or the like and therefore will not harbor bacteria thereby eliminating or reducing another source of contamination. In addition to the non-metallic fiber, the metallic fiber 26 is in the form of strands of small but flexible and strong wire of stainless steel, aluminium or the like which has sufficient strength and flexibility for use in a glove with the glove being sufficiently flexible to enable manipulation of knives and other items with the requisite facility desired in a glove but yet the small metallic wires 26 will materially strengthen the glove and render it more durable with the characteristics of the metal wire and aramid fiber coacting to produce a lightweight, durable glove which is devoid of buckles, straps and other fastening devices.

While aramid fiber strands are preferred, other flexible natural or man made fibers may be utilized and other flexible material may be employed in which the metallic or wire strands are impregnated, such as latex, rubber and the like. The combination of the flexible non-metallic fiber strands and the flexible metallic fiber strands enables a knife handle or other device to be more securely gripped than when a conventional metal mesh glove is used which is constructed from a plurality of interconnected metal rings since the metal rings have a tendency to slip or slide along a surface of a knife handle whereas the non-metallic fibers tend to flex and conform with and thus more securely grip the knife handle or other equipment. Also, the construction of the glove by using conventional glove manufacturing machinery and conventional techniques enables the gloves to be manufactured at a substantially less cost than conventional metal mesh ring gloves. The light-weight construction of the present glove as compared to the conventional metal mesh ring glove materially reduces the fatigue of persons wearing the gloves thus enabling higher productivity and safer manipulation of knives and the like for greater periods of time since fatigue frequently introduces increased incidences of injury due to inaccurate or slow manipulative movements.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A glove for use by persons whose hands are subject to injury such as an operator in a meat processing plant who uses a knife during various meat cutting procedures, said glove being constructed of a flexible woven, non-woven or knitted fabric constructed of flexible aramid fiber yarn strands, such as "Kevlar", and flexible metal wire strands, said strands being associated to form a glove, said glove being substantially impenetrable by a knife or the like thereby protecting the wearer from accidental injury.

2. The structure as defined in claim 1, wherein said glove includes a wrist covering portion of elongated construction for protecting the wrist and forearm for a substantial length.

* * * * *